United States Patent [19]

Zernov et al.

[11] 4,147,104

[45] Apr. 3, 1979

[54] KEY COLOR CONTROL SYSTEM FOR PRINTING PRESS

[75] Inventors: Peter Zernov, Oconomowoc; Raymond E. Young, New Berlin; Gilbert S. Woythal, Milwaukee, all of Wis.

[73] Assignee: Zerand Corporation, New Berlin, Wis.

[21] Appl. No.: 877,503

[22] Filed: Feb. 13, 1978

Related U.S. Application Data

[63] Continuation of Ser. No. 757,895, Jan. 10, 1977, abandoned.

[51] Int. Cl.[2] ..... B41F 5/06; B41F 5/16

[52] U.S. Cl. ..... 101/181; 101/228; 226/44

[58] Field of Search ..... 101/181, 248, 228; 226/25, 27, 28, 29, 30, 31, 42, 44; 318/6; 235/92 MP; 73/95.5

[56] References Cited

U.S. PATENT DOCUMENTS

| | | | |
|---|---|---|---|
| 3,025,791 | 3/1962 | Auerbacher | 101/181 |
| 3,087,663 | 4/1963 | Anderson | 226/44 |
| 3,326,436 | 6/1967 | Huck | 226/44 X |
| 3,594,552 | 7/1971 | Adamson | 101/181 |

FOREIGN PATENT DOCUMENTS

| | | | |
|---|---|---|---|
| 2356820 | 5/1975 | Fed. Rep. of Germany | 101/181 |

*Primary Examiner*—J. Reed Fisher
*Attorney, Agent, or Firm*—James E. Nilles

[57] ABSTRACT

A key color control system for a multicolor rotogravure printing press maintains a constant actual base printing repeat length at the key color printing deck. A control system for a printing press comprises means to detect and measure the magnitude of a repeat length error as it is printed by a key color deck and further comprises means to correct for the repeat length error by varying the tension on the web ahead of the key color deck. The system includes means for establishing high and low limits within which repeat length errors of certain magnitude are likely to occur and for which correction is made. The system also includes means for warning the press operator that there is a trend in the change in magnitude of repeat length errors to exceed the limits so that the press operator may either establish new limits or establish a new base repeat length within the same limits so that repeat length errors of a different magnitude (usually smaller) are likely to occur. When a new tension level is established, correction is made then for deviations from the new base repeat length. The system further includes automatic reset means operable when a new base repeat length is established to ensure rapid establishment of the new tension level on the web.

2 Claims, 18 Drawing Figures

| NUMBER COUNT | $V_{IN}$ | $V_{OUT}$ |
|---|---|---|
| 0 | 0 | 0 |
| 20 | .1 | 2 |
| 40 | .2 | 4 |
| 60 | .3 | 6 |
| 80 | .4 | 8 |
| 99 | .5 | 10 |

RESET FUNCTION OF COLOR CONTROL SYSTEM
ASSUMING: ROLL REQUIRES ΔPLI = +8 THROUGH 3/4 OF ROLL
: ROLL REQUIRES ΔPLI = −4 FROM 3/4 ROLL TO CORE
: STARTING TENSION = 10 PLI, LIMIT SET AT 16PLI
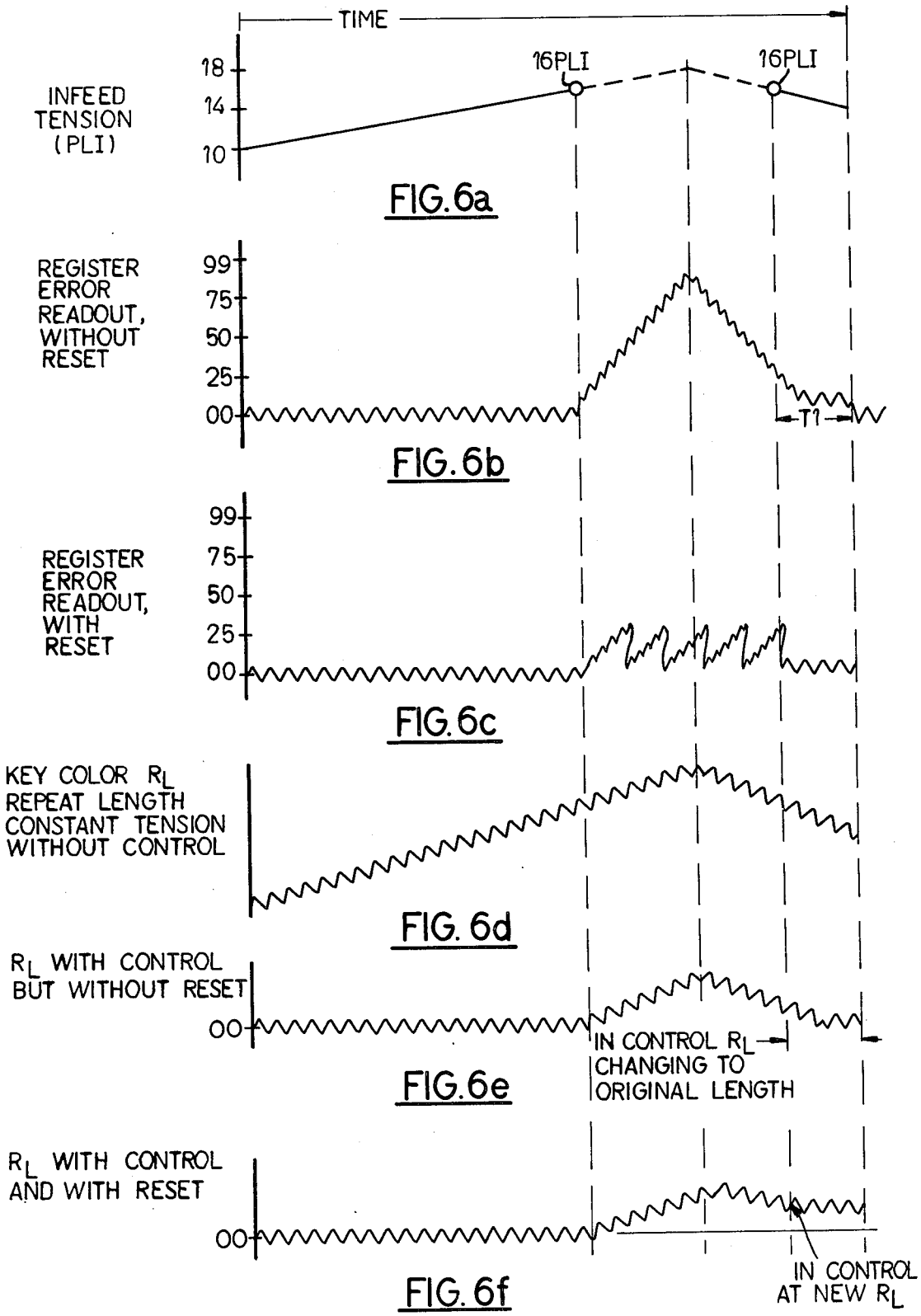

KEY COLOR CONTROL SYSTEM FOR PRINTING PRESS

REFERENCE TO RELATED CO-PENDING APPLICATION

This application is a continuation of Ser. No. 757,895, filed Jan. 10, 1977, and now abandoned.

BACKGROUND OF THE INVENTION

1. Field of Use

This invention relates generally to register control systems for web-processing apparatus, such as multicolor rotogravure printing presses which have a plurality of color decks.

In particular, it relates to register control systems for maintaining a constant actual base repeat length at the key color deck thereby reducing or eliminating key color repeat length errors.

2. Description of the Prior Art

The fields of publication, packaging, and newspaper printing demand high quality color registration. Each color must be accurately applied to a specific spot on the moving web. Prior art automatic register control systems aim to reduce mis-register waste caused by small or large errors which were previously detectable only after the final product was printed. A typical register control system inspects a moving web in a printing press and regulates servo motors to vary web length and tension and to maintain precise registration between color units. In a typical multicolor printing press the first significant color cylinder (usually yellow) at the key color deck prints a small register mark on the web along with each illustration. The marks are scanned at subsequent printing decks on the press to detect variations in web length. Under tension, the web elongates in various degrees, dependent upon moisture content, caliper, cylinder sizes, dryer temperature, and any manual and automatic adjustments made to the press during a run.

To correct for mis-register, there are two types of compensation commonly used on presses—web compensation and cylinder compensation. On a press using cylinder compensation, the printing cylinder is rotated to change the location of the printing between printing decks. On a press using web compensation, a movable compensator is operated between the printing decks to change the length of web between two decks. As web length changes between decks (increases or decreases), the position the cylinder prints downstream of the preceding deck advances or retards. To advance the printing refers to movement of the printing towards the exit end of the press; to retard refers to movement away from the exit end of the press.

Publication gravure, letter-press, offset and packaging gravure presses sometimes use cylinder-to-mark register control systems. Such a system receives part of its information from a register mark printed on the web and part of its information from a reference mark generated by or directly related to print cylinder position. The reference mark, generated once per cylinder revolution, is transmitted to a computer in a register control wherein it is compared to the arrival of a scanner signal produced by the register mark. An encoder provides for machine time increments, for example, and sends out a series of 20,000 pulses or digits per cylinder revolution. Signals based on the reference mark and the scanner signal should arrive simultaneously. Any difference measured by one or more encoder pulses is counted and sent out as a registration error signal to operate or adjust the compensator. Accuracy of a register control system is a function of the number of divisions into which the printing repeat length is divided by the encoder and in this example is 1/20,000 of the repeat length. Register control systems are used with presses which operate at speeds up to 2500 feet of web per minute.

It is known that the majority of all intercolor register errors in rotogravure printing is caused by changes in the actual print repeat length in the first or key color deck and the response of sebsequent colors to this error. Prior art printing register control systems as hereinbefore described attempt to sequentially match intermediate colors to the actual repeat of the first or key color. It is also known, however, that maintenance of the desired actual print repeat length in the first or key color deck depends on maintaining the tension level appropriate to the condition of the web material being printed.

Variation of actual print repeat length of the first or key color may be caused by either one of two variables; first, a variation of the tension going into the first or key color deck caused by tension transients in the web introduced from the unwind roll, butt splicer, infeed control, speed changes in web speed, and second, variations in the web material being printed, such as moisture content or board (web) caliper. All of the above-mentioned variables, when introduced into a press operating in a steady state condition, require the establishment of a new infeed web tension level rather than reestablishment of a constant preset tension in order to maintain a constant repeat length of the key color.

Thus, print register errors can occur in the key color deck that are permanent in nature, that is, they represent a change in the print repeat length. Thus, change in repeat length is caused by changes in the web physical characteristics, i.e., moisture content, caliper, elasticity, etc., and is most noticeable across a roll splice. Key color repeat length changes can also occur on a gradual basis throughout a web roll as the web characteristics change between the outermost wraps and the core of the web roll.

Primary register control systems, as hereinbefore described, responding to intermittent and cyclic print errors, operate to maintain a printed register mark applied by the key color deck print cylinder in a fixed position relative to a subsequent printing cylinder reference position and thus do not correct for a fixed change in key color repeat length. The resulting register error at each printing deck after the first color is referred to as a phase error. Test analysis has shown that this phase error magnitude is not a constant for each printing deck, and may be as high as 0.030 of an inch for one color. Corrections for phase error on presses equipped only with a primary register control system were heretofore made manually. Unfortunately, manual corrections require greater press operator attention and are made "after the fact," that is, when the misregistered blanks are on the delivery table and the press is loaded with misregistered web.

U.S. Pat. Nos. 2,082,705 and 3,025,791 are prior art examples of web processing apparatus wherein infeed web tension is controlled automatically in response to marks on the web. However, the prior art does not teach repeat length or key color controls which take into account the fact that repeat length changes sometimes represent more than transitory changes and, in fact, are actually permanent changes which require a new or different set of parameters within which repeat length errors of a different magnitude are to be sensed and corrected for by establishment of a new infeed tension level.

SUMMARY OF THE INVENTION

A key color control system in accordance with the invention is provided for web processing apparatus, such as a multicolor rotogravure printing press having a plurality of color decks. The key color control system maintains a constant actual printing repeat length on the web at the first or key color printing deck, thus minimizing the need of subsequent color decks to adjust to a key color error. The key color control system comprises means to detect and measure the magnitude of a repeat length error printed by the key color deck and means to correct for the error by varying the infeed tension level on the web ahead of the key color deck so as to either maintain a predetermined tension level (if the change is transitory) or establish a new tension level (if the change is permanent or long term). The key color control system includes means for establishing predetermined limits within which repeat length errors of certain magnitude are likely to occur and for which correction is made by maintaining constant repeat length by appropriate adjustment of tension level, and means for determining and indicating that a trend in change in magnitude of repeat length errors is occurring, which is a departure from the predetermined limits, so that either new predetermined limits may be estblished or a new base repeat length may be established within existing limits so that repeat length errors of a different magnitude (usually smaller) are likely to occur. Correction is made for repeat length errors of a different magitude by establishing a new tension level. The system further includes automatic reset means operable when a new base repeat length is established within previously set limits to ensure rapid establishment of the new tension level on the web.

The key color control system comprises scanner means, including a key color optical scanner located after the key color deck for sensing the register mark applied to the web in the key color deck and for providing a register mark signal corresponding thereto; encoder and pulse generator means for generating a reference mark signal in the form of pulses indicative of a reference mark on the printing cylinder in the key color deck; a register control, including digital computer means for receiving and comparing the registration mark signal from the web and the reference mark signal from the printing cylinder, to provide a repeat length error signal indicative of the magnitude and direction of a repeat length error, which repeat length error signal is converted to a control signal; and web tension control means, including a pivotable rotatable dancer for exerting pressure on the web to affect web tension, and dancer drive means for moving the dancer, said drive means being responsive to said control signal from the register control to adjust web tension accordingly, said dancer drive means including a pneumatic cylinder connected to the dancer and a motor-driven air regulator valve for the cylinder.

The key color system further comprises limit control means responsive to a feedback signal resulting from the operation of the dancer drive means and indicative of the tension being exerted on the web by the dancer. As the repeat length printed on the web increases or decreases from the actual cylinder repeat length, the repeat length error signal into the computer is integrated and differentiated to determine both the direction and magnitude of error. The output signal from the computer is a signal to the motor which drives the air regulator valve to increase or decrease air pressure to the pneumatic cylinder for the infeed dancer roll, thus increasing or decreasing the tension on the web material coming into the key color deck which causes a decrease or increase, respectively, in the key color repeat length.

The rate and level of change to the infeed tension can be varied internally in the key color control to accommodate both material caliper and moisture changes in addition to dancer roll, splicer transients, and speed changes. Thus, the key color control system also includes limit control means including a limit circuit for establishing predetermined limits within which repeat length errors of certain magnitude are likely to occur and for which correction is made, and an anticipate circuit for determining and indicating that the trend in change in magnitude of repeat length errors is to depart from the predetermined limits, so that new predetermined limits may be established within which repeat length errors of a different magnitude are likely to occur, whereby the system then corrects for repeat length errors within the new limits. The key color control system also includes automatic reset means operable when a new base repeat length is established within previously set limits to ensure rapid establishment of the new tension level on the web.

The limit control means includes a limit relay circuit connected to the register control which can be set by the press operator to establish upper and lower limits in PLI (pounds per linear inch) within which the dancer will exert tension. The limit control means also includes an anticipate relay circuit which can be set by the press operator to determine that, and provide a warning signal when, the magnitude of repeat errors is changing to such a degree that establishment of a new set of limits or establishing a new base repeat length for infeed tension is warranted by the press operator because a permanent change in web condition is appearing.

Thus, the key color control system has the ability to ascertain the magnitude and direction of the repeat length error signal and translate the error signal to a control signal for a tension control device (the dancer) which then either restores a tension variation to a specific tension level required or establishes a new tension level consistent with that demanded for a preset printed repeat length, as dictated by a change in the characteristic of the material printed. The tension control device must be capable of maintaining accurate tension control of the material being fed into the first color deck and be further capable of rapid and proportional response to tension change demands from the measured error of actual print repeat length in the first key color deck.

The key color control system in accordance with the invention embodies a closed loop error feedback system principle and measures and controls the key or first color print repeat length and maintains subsequent press color-to-color register at a high degree of accuracy regardless of material variations or transients due to the infeed dancer motion or butt splicer operation.

Other advantages of a key color control system in accordance with the invention over prior art preset infeed web tension controls using a primary register control for intercolor tension control are that the first or key color repeat length error is scanned and sensed after it is printed, with the error correction initiated simultaneously with sensing. This prevents repeat length deviations of the key color from entering the subsequent printing decks, thus providing a more stable web condition into the subsequent deck which reduces misregister. Furthermore, maintaining a balanced and stable condition between the first and second printing nips creates a more balanced condition between all other subsequent printing nips thus minimizing further intercolor misregister.

The key color control system is adaptable to any one of the color decks of a gravure press, and depending on the key color location, can be implemented by positioning a selector switch to bring into play optical scanners for repeat length control located at the several color decks.

Although the embodiment disclosed employs apparatus wherein the register mark printed on the web is compared to a reference mark related to printing cylinder position, it is apparent that the invention can be employed in apparatus wherein "mark to mark" registration is employed, i.e., apparatus wherein two spaced apart optical scanners at predetermined locations sense and measure whether there is time registration or not between two spaced apart register marks printed on the web.

BRIEF DESCRIPTION OF THE DRAWINGS

FIGS. 6*a* through 6*f* are graphs depicting web infeed tension plotted against time during different operating conditions of the press and control system.

DESCRIPTION OF A PREFERRED EMBODIMENT

Figure 1:
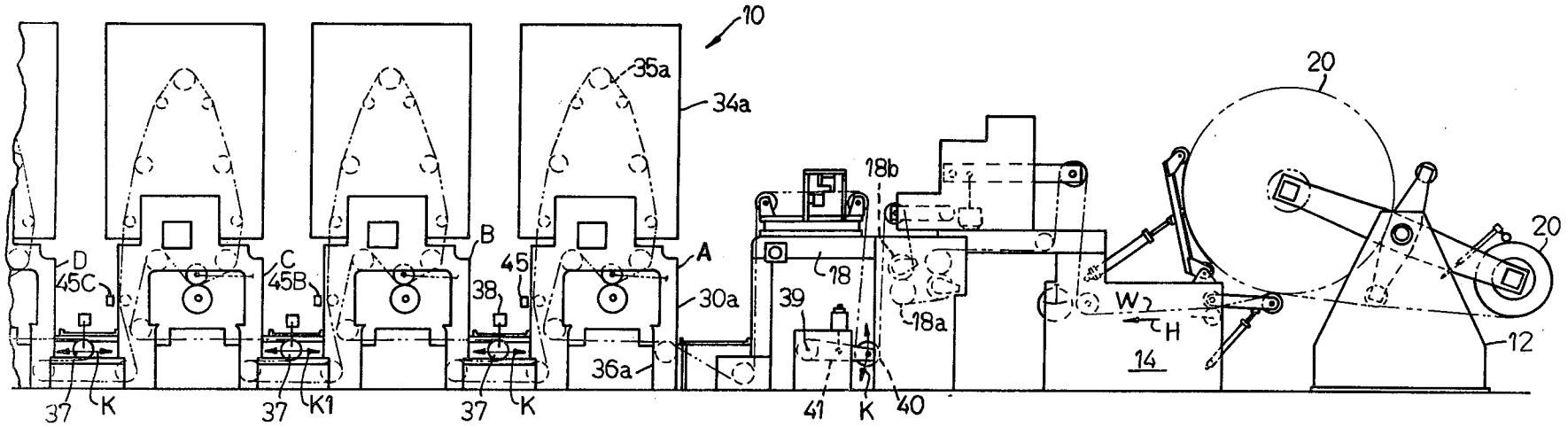
FIG. 1 is a side elevational view of a portion of a multicolor rotogravure printing press with which a key color control system in accordance with the invention is advantageously employed.

FIG. 1 shows web processing apparatus of a type with which a key color control system in accordance with the invention is advantageously employed. The apparatus comprises a printing press 10, having four color printing decks A, B, C, and D; a roll stand 12; a butt splicer unit 14; a web infeed and decurl unit 18; and a cutter unit (not shown). A web W drawn from a web roll 20 on stand 12 passes in the direction of the arrows H through butt splicer unit 14, web feed and decurl unit 18, the press 10 wherein it is imprinted and the cutter unit (not shown) wherein printed segments are cut therefrom and subsequently stacked. Web W may be paper, paperboard, plastic film, metal foil or the like, or a laminate of any two or more such materials.

Figure 2:
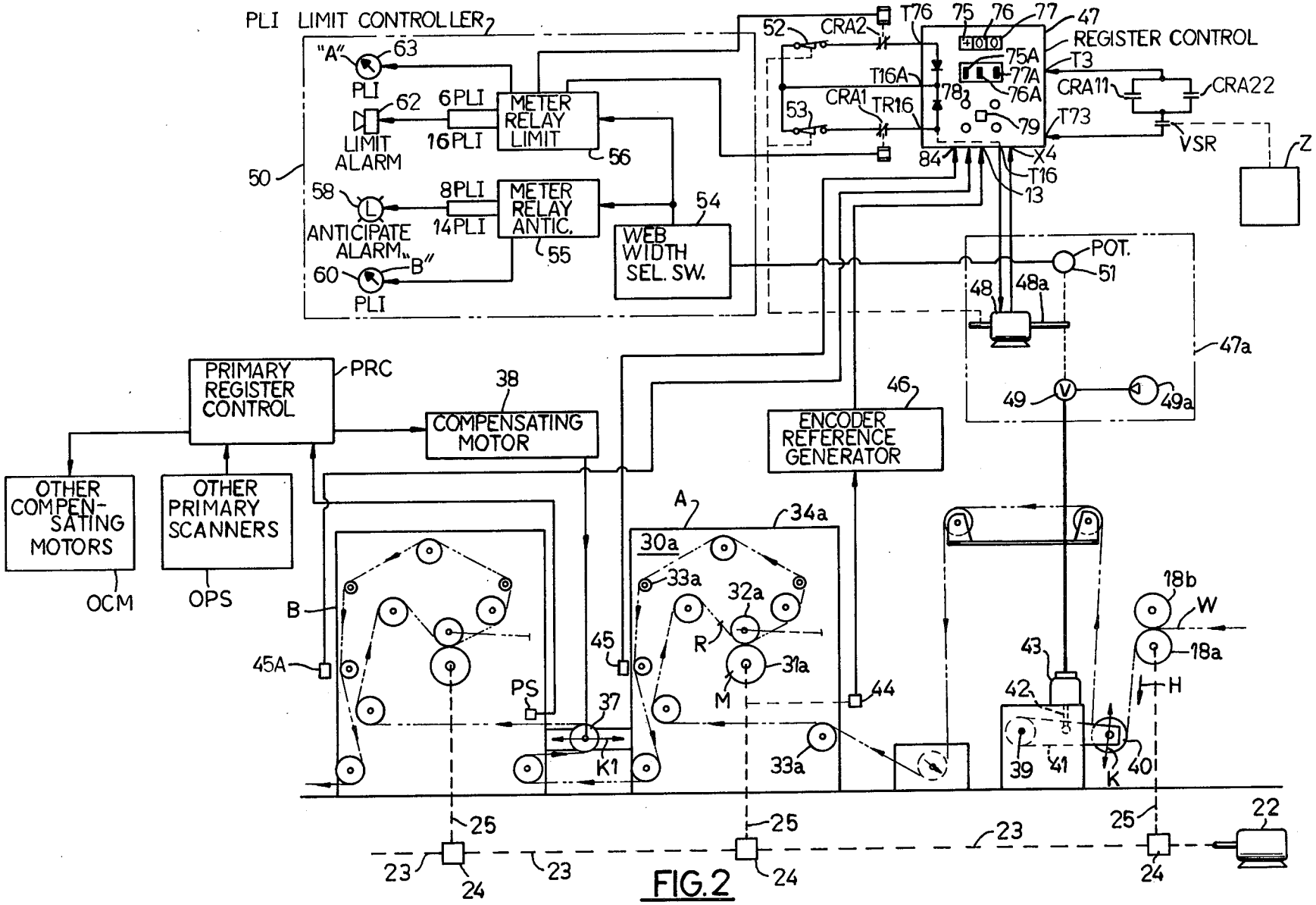
FIG. 2 is a schematic diagram of a portion of the press shown in FIG. 1 and the key color control system in accordance with the invention.

The apparatus is line-shaft driven in a conventional manner so that all movably driven components in press 10, in the unit 18, and in the cutter unit (not shown) are mechanically driven in synchronism at appropriate selective speeds thereby enhancing web registration and ensuring a taut web. Thus, as FIG. 2 shows, an electric motor 22 drives a line-shaft 23 which is connected by gear boxes 24 to power take-off shaft 25 which are connected to the driven components in the associated units and press 10.

The printing decks A, B, C, and D are similar in construction and mode of operation and corresponding parts are designated, where necessary, by the same reference numeral suffixed by the letters a, b, c, and d, respectively. In the following disclosure the first deck A, B, C, D to imprint a color, or at least a register mark, on web W is referred to as the first or key color deck. In practice, deck A would normally be the key color deck in multi-color printing. However, any one of the decks A, B, C, or D could be the key color deck.

Since the decks A, B, C, D are similar, only deck A is hereafter described in detail. As FIGS. 1 and 2 show, deck A comprises a frame 30*a* upon which are mounted a driven printing roll 31*a*, an impression roll 32*a*, a plurality of idler rollers 33*a*, and a dryer 34*a* having suitable idler rollers 35*a* therein. Deck A when in operation is provided with an ink cart (not shown) which contains ink of an appropriate color and which is insertable through an opening 36*a* in frame 30*a*. Compensator rollers 37 are located between adjacent printing decks and each roller 37 is drivable in the direction of an arrow K1 by a compensator motor 38.

Web infeed unit 18 comprises a pair of driven pull rollers 18*a* and 18*b* between which web W passes and by means of which the web is drawn from the roll 20. Web infeed unit 18 is provided with a dancer roll 40 which is rotatably mounted on a pair of spaced apart support arms 41 (only one of which is shown) which are pivotally movable in the direction of an arrow K about a pivot point 39 by means of a piston rod 42 of a pneumatic cylinder 43 so as to apply an appropriate amount of tension on that portion of web W between the nip of pull roller 18*a* and 18*b* and the nip of the driven printing roll 31*a* and impression roll 32*a*, as hereinafter explained.

In operation of the apparatus, web W is drawn from roll 20 and passes through butt splicer unit 14, web feed and decurler unit 18, and thence between impression roll 32*a* and the printing roll 31*a* in deck A in firm contact with both whereby a first color is imprinted. The web W is then directed through dryer 34*a* where the inked pattern is heat-set or dried. Upon leaving the dryer 34*a*, the web passes through the first web compensator comprising movable compensator roller 37, and to printing deck B. The web W, after receiving the pattern printed at deck A, which includes a register mark R, as hereafter described, passes in succession through decks B, C, and D in the same manner as above described with reference to deck A. At each of the decks B, C, and D, the web W receives a printed pattern in addition to that applied at deck A. To obtain the desired results in the final composite copy, each of the separately applied patterns must be held in proper spaced relationship (register) to each other on the web. Normally, in a four-color operation such as here illustrated, for example, deck A will print a pattern in yellow ink, deck B in red, deck C in blue, and deck D in black, although other color combinations could be used. The final composite copy may have areas of any or all of these individual colors and may also have areas in which any two or more of these individual colors are combined to form such composite colors as, for example, orange, green, purple, brown, etc. From printing deck D, the web W, now carrying the four-color copy, is understood to be directed to the cutter unit (not shown) which severs blanks from the web. The severed blanks are propelled onto a suitable collecting table (not shown) where they are formed into a pile.

Figure 3:
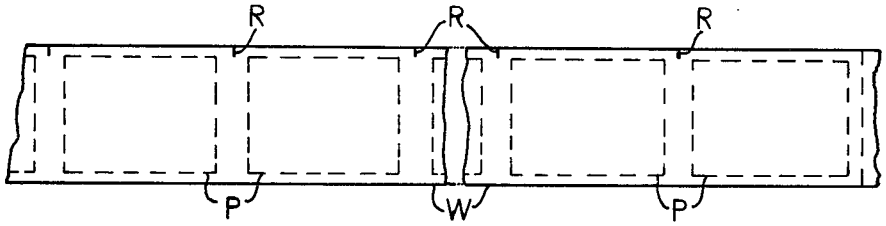
FIG. 3 is a top plan view of a portion of the web shown in FIGS. 1 and 2 showing imprinting and register marks thereon.
Figure 4:
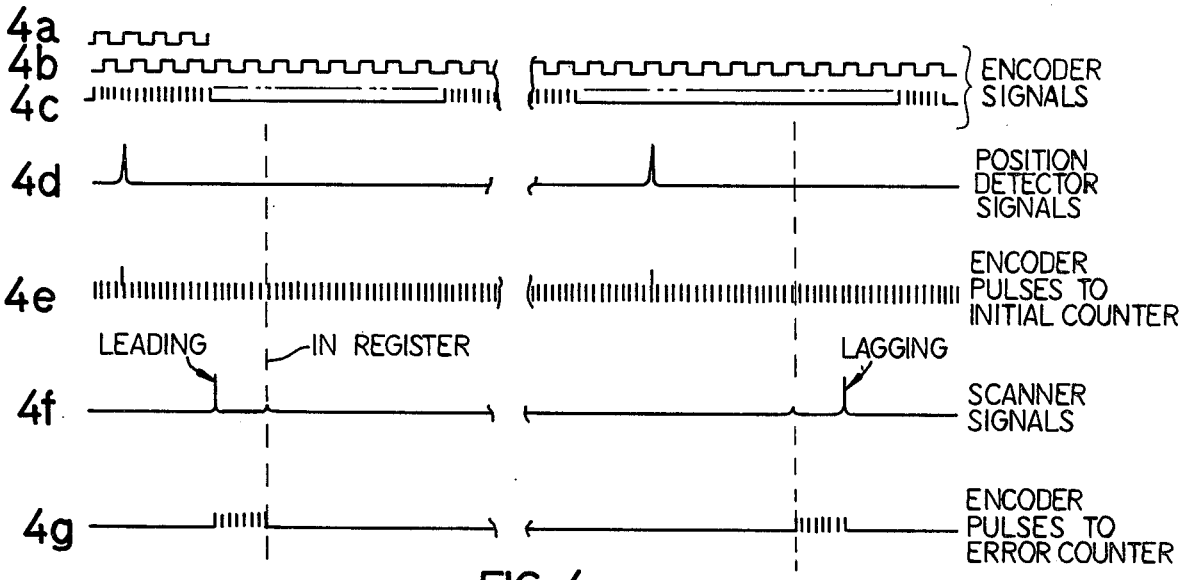
FIGS. 4*a* through 4*g* are diagrams showing wave forms relating to register marks or reference marks in certain portions of the key color control system.

FIG. 3 shows a length of the printed web W carrying the composite printed patterns P, which are diagrammatically illustrated by the dotted lines. In the case illustrated, the web W is to be severed substantially along the edges of adjacent printed patterns and the location of the cuts are coincidental with the lines P. The first color printed (at deck A in FIGS. 1 and 2) includes the register marks indicated at R in FIGS. 2 and 3 which are applied to the web W, preferably but not necessarily in a clear track (devoid of other printing) along the length of the web, such as an edge margin.

As FIGS. 1 and 2 also show, the apparatus is provided with a conventional primary register control system which includes a primary register control PRC for receiving signal information from a primary scanner PS located between decks A and B and for operating a compensating motor 38 for compensator roll 37 located ahead of deck B. The primary register control system further includes other primary scanners OPS and other compensating motors OCM for operating their respective dancers 37 located ahead of the color decks C and D.

As FIGS. 1, 2, 4, and 5 further show, in accordance with the invention, a repeat length control system is provided for use with the aforedescribed apparatus to maintain a constant actual printing repeat length at the key color printing deck A. Generally considered, the repeat length control system comprises a photoelectric repeat length scanner 45 for sensing the mark R and providing a position detect or error signal (see FIG. 4*d*); a reference signal generator 44 and encoder 46 for providing a reference signal indicative of the position of a mark M on printing cylinder 31*a* of deck A (see FIGS. 4*a*, 4*b*, and 4*c*); a register control unit 47 for receiving the error signals and the reference signals (see FIG. 4*e*); and for providing an output or control signal, based on encoder pulses to the error counter shown in FIG. 4*g*, to an electric compensator motor 48 having a shaft 48*a* which operates a regulator valve 49 for controlling air pressure from a source 49*a* to the pneumatic cylinder 43 for the infeed dancer 40. FIG. 4*f* shows diagrammatically register mark signals which are leading and lagging. As FIGS. 1 and 2 show, repeat length scanner 45 is shown located after deck A which for purposes of the present description has been selected as the key color deck. However, with deck A as the key color deck, scanners located as at 45B or 45C could be used as the repeat length scanner, instead of scanner 45, since they are located downstream of the key color deck. Furthermore, any deck A, B, C, D could be selected as the key color deck and any scanner 45, 45A, 45B, 45C could be used as the repeat length scanner provided it is downstream of the selected key color deck.

As FIG. 2 shows, the signals from scanner 45 and encoder 74 are directed to the register control unit 47 which contains an electronic computer. The manner in which the signals and encoder pulses supplied to the computer of each console section are compared is shown graphically in FIG. 4. An Accutrol Model 631 register control unit manufactured by Hurletron Incorporated, Controls Division, 1938 East Fairchild, Danville, Illinois, 61832, employed in accordance with the invention as hereinbefore explained, is suitable for use as a register control unit in accordance with the invention. The Model 631 device is also usable as the primary register control PRC. The Model 631 register control unit is described in detail in an operator's and maintenance manual therfor which is available from Hurletron Controls at the above address.

Digital output signals are derived in the computer circuits of the register control unit 47 and are supplied to a motor control circuit for the compensator motor 48 for the air regulator valve 49 of cylinder 43 of infeed dancer 40. In response to the signals, the motor 48 operates in the proper direction to cause operation of an air regulator valve 49, cylinder 43 and infeed dancer to correct the error in register by applying tension to web W. The compensator motor 48 may be, for example, a reversible DC motor which operates in a direction dictated by the polarity (direction of flow) of the current supplied thereto and at a speed proportional to the applied voltage. Register control unit 47 also contains a digital display device comprising, for example, three electronic display tubes 75, 76, and 77. Two tubes 76 and 77 display a digit of from zero to nine, inclusive. In normal operation, the two most significant digits of the error counts are displayed by tubes 76 and 77. The third display tube 75 will show a plus sign when the work applying cycle to which the numerical value of the display applies is longer than the distance on the web between the register marks, i.e., the repeat length. The display of a negative sign by tube 75 indicates that the work interval involved is shorter than the repeat length. When there is no register error, zeros are displayed.

Register control unit 47 also includes vernier adjustable thumb switches 75A, 76A, and 77A which provide a means of controlling the fine register of each unit. Initially set, for example, at 455 at the start of a run, the switches operate over a range of 000–999 so that the press operator can shift the set point while on automatic control. The switch 75A controls hundreds; the middle switch 76A, tens; and the switch 77A, units. Changing the right hand switch 77A one digit produces a shift of register of approximately 0.001 on a 20 inch cylinder, for example.

A memory set push button 78 is used during set-ups when the system is in the memory set mode. The button 78 is pressed momentarily to command the unit to count and store the number of encoder pulses or digits that are to be included in the "main counter" sequence. The memory setting operation is completely automatic and will be performed in the first full revolution after the memory set small button 78 is released. The button 78 is disabled in the automatic mode. A manual control knob 79, movable from a spring centered manual position to either advance or retard positions, is normally in the spring centered position. When rotated toward advance, contacts close to operate the electric motor 48 in the compensator actuator 47*a* and the motor runs at full speed as long as the switch is made. Advance action moves the controlled printing toward the folder. When the switch is rotated to retard, the motor runs in the reverse direction. In automatic control, the manual switch is disabled and cannot control the compensator actuator motor 48.

As FIG. 2 shows, register control unit 47 is provided with terminals T3 and T73 across which the memory set push button 78 is understood to be connected. In Applicants' invention, an automatic reset circuit, comprising a contact VSR of a voltage sensitive relay Z and a pair of meter contacts CRA11 and CRA22, is connected across the terminals T3 and T73, as hereafter explained.

Contact unit 47 is also provided with terminals T76, T16A and TR16 which are connectable, as hereafter described, to control energization of motor 48.

Figures 5, 5A:
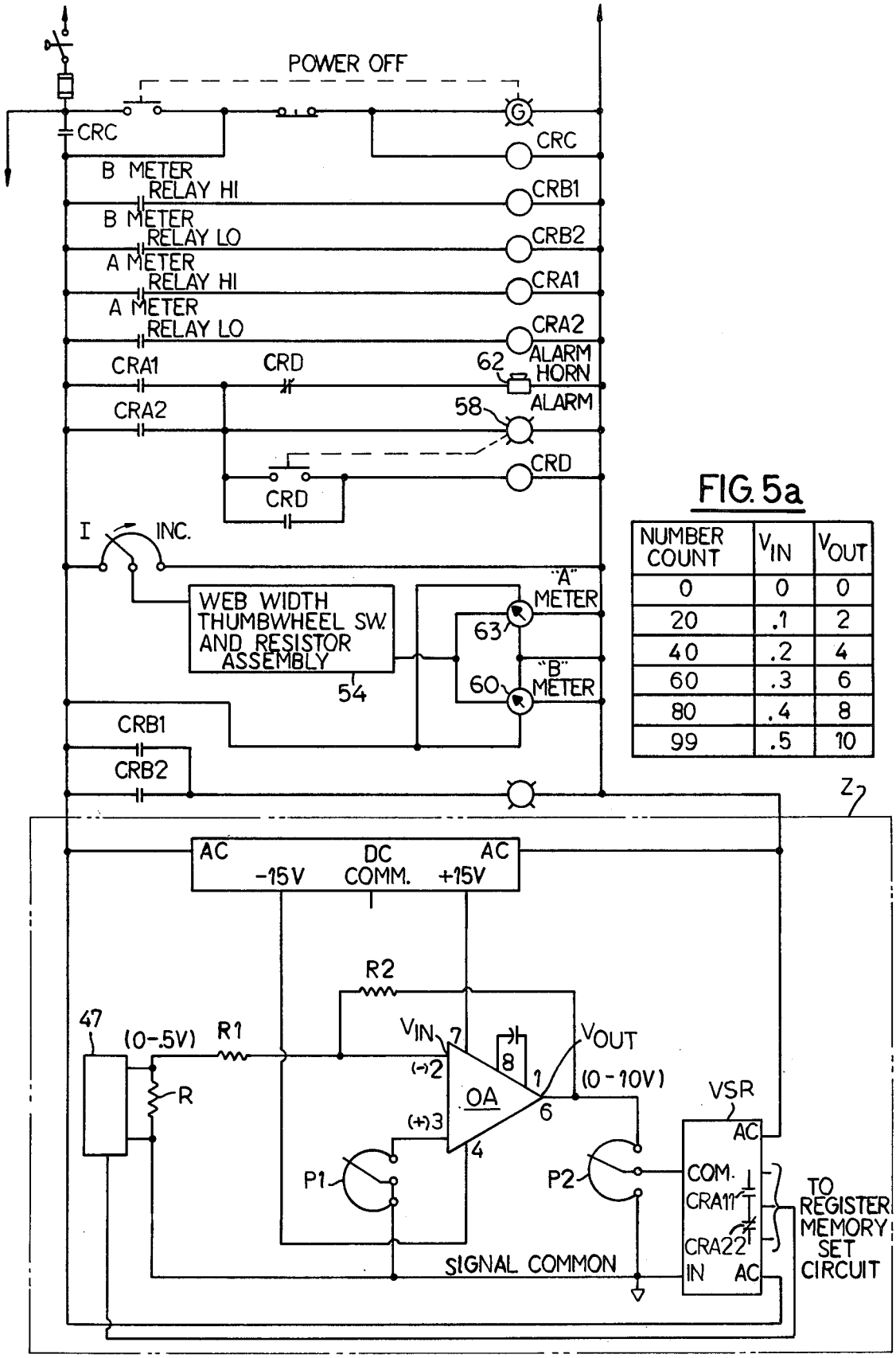
FIG. 5 is a schematic diagram of a portion of the control system shown in FIG. 2.
FIG. 5*a* is a chart depicting the relationship between signal voltage and meter readout produced by the reset control in the control system.

As FIGS. 2 and 5 best show, the repeat length control system further comprises a limit control unit 50 which receives an input control (feedback) signal from a potentiometer 51 which is driven by and responsive to the position of shaft 48*a* of compensator motor 48. Limit control unit 50 provides output signals to operate a low limit switch 52 and a high limit switch 53 to control the ability of the register control unit 47 to energize the motor. Limit control unit 50 comprises a web width selector switch 54 which receives the input control signal from potentiometer 51 and provides control signals to an anticipate relay 55 and a limit relay 56 which are part of limit control unit 50. Switch 54 enables an indication of web tension appropriate to web width. Anticipate relay 55 is connected to operate an anticipate alarm light 58 and to provide a readout on a meter 60 ("B" meter) indicative of web tension being exerted by dancer 40 in PLI (pounds per linear inch). Limit relay 56 is connected to operate a limit alarm 62 and to provide a readout on a meter 63 ("A" meter) indicative of web tension being exerted by dancer 40 in PLI. The control signal to the relays 55 and 56 takes the form of a voltage representative of the pounds per linear inch exerted by dancer 40 on web W as enabled by switch 54. Limit relay 56 can be preset by the press operator to establish a predetermined range (upper and lower) within which repeat length error signals must fall in order to effect a change in web tension, such as for example a range between 6 PLI and 16 PLI. Anticipate relay 55 can be preset by the press operator to establish a range narrower than the predetermined range of the limit relay 56 (such as for example 8 PLI and 14 PLI) so that, if repeat length error signals begin to depart from the narrower range, the anticipate alarm 58 is energized to warn the press operator of this fact, whereupon the press operator knows that a change in repeat length is occurring requiring pressure near established limit and he can reset the limit relay 56 to provide appropriate new limits or reset the register control 47 to establish a new base repeat length.

As FIGS. 1 and 2 show, photoelectric repeat length scanner 45 is located on the downstream side of the deck A (which is chosen as the key color deck in this description) to detect the recurrent register marks R. Scanner 45 provides an abrupt electrical signal upon each occurrence of mark R at the scanned location (see FIGS. 4*d* and 4*f*). A cylinder position detector 44 is mechanically coupled to and runs at the same rotational speed as the printing cylinder 31*a*. The detector 44 provides an abrupt electrical signal once per revolution of the cylinder to which it is coupled (see FIG. 4*d*). The signal, which is fed along with encoder pulses to register control 47 (to produce signals such as shown in FIGS. 4*c*, 4*d*, and 4*e*) occurs at a predetermined, fixed angle of rotation of the cylinder 31*a*. Thus, when a scanner signal occurs at scanner 45, the signal from cylinder position detector 44 should occur before that detector has rotated through a definite, predetermined angle. This required angle of rotation is represented by definitely known number of pulses from the encoder 47 (see FIG. 4*e*). With the drive arrangement shown in FIG. 2, it is possible to drive the detector 44 and the encoder 47 directly from shaft 23. The encoder 46 generates a continuous train of pulses, each of which represents a uniform but very small increment (angle) of rotation of the printing cylinder 31*a*. This train of encoder pulses is supplied to the register control unit 47. As hereinbefore mentioned, a "mark to mark" register system could be employed instead of that disclosed herein. As FIG. 2 shows, the signals from scanner 45 and encoder 46 are directed to the register control unit 47.

As will be understood with reference to FIGS. 2 and 5, the "Hi" and "Lo" relay contacts of the "A" meter 63 and "B" meter 60 are contacts which are related to meter needle position. The relay contacts CRB1 and CRB2 in FIG. 5 correspond to the relay contacts in meter relay 55. The relay contacts CRA1 and CRA2 correspond to the contacts for limit relay 56. The needle of "A" meter 63 thus controls the relay contacts CRA1 and CRA2 as follows. If the needle of meter 63 goes to its high limit (set by the press operator), then relay CRA1 opens its corresponding contacts and the register control 47 prevents motor 48 from operating. Similarly, if the needle of meter 63 goes to its low limit (set by the press operator), then relay CRA2 opens its corresponding contacts and the register control 47 prevents motor 48 from operating. However, the scanner 45 is still operating and detecting errors but is unable to cause register control 47 to operate the dancer 40 because the limits set by the operator have been reached. It should be noted that the mechanical limit switches 52 and 53 are in series with the relay contacts CRA2 and CRA1, respectively, and when open prevent operation of motor 48 thereby preventing damage to components, such as potentiometer 51, connected to shaft 48*a* of motor 48 thereby preventing damage thereto.

Referring to FIGS. 2, 5, 5*a*, 6, and 6*a*–6*f*, the reset circuit Z for the key color control system will now be described. As FIG. 5 shows, register control 47 includes an internal resistor R across which a voltage signal (0–0.5v) appears. This voltage signal is proportional to the repeat length error. This voltage signal is fed to an operational amplifier OA in circuit Z which in turn provides an output signal (on the order of 0–10v) to a voltage sensitive relay VSR. The voltage sensitive relay is provided with contacts VSR which actuate a register memory set circuit in register counter 47. As FIG. 2 shows, contact VSR is connected in series with a pair of contacts CRA11 and CRA22, which are parallel with each other, across the reset terminals T3 and T73 of register control 47, as hereinbefore described. As FIG. 5*a* makes clear, for example, when the input voltage $^{V}$IN and $^{V}$OUT are at the levels indicated in the table in FIG. 5*a*, the number count appearing as the readout on register control 47 assumes the values indicated in the table. The reset circuit shown in FIG. 5 operates so that, for example, when the register error count reaches the numeral 25, then the voltage sensitive relay VSR operates a contact in register counter 47 so as to reset register control 47 to zero. The purpose and advantage of the reset circuit is best understood by reference to FIGS. 6*a*–6*f*.

As FIGS. 2 and 5 make clear, the relays CRA1 and CRA2 in addition to operating their respective contacts CRA1 and CRA2, also operate the contacts CRA11 and CRA22, respectively, in the reset circuit. Consequently, if relay contacts CRA1 open on high limit or relay contacts CRA2 open on low limit, either CRA11 or CRA22 would close, but if voltage sensitive relay contact is still open, the reset circuit Z does not effect its reset function. However, scanner 45 still senses register errors. As the register error increases in size, the count in the register control 47 increases and the size of the error is displayed thereby. When the error reaches a preselected numerical value determined by the design of reset circuit Z and the new level set by the operator on thumbwheels 75A, 76A, 77A, the circuit Z effects closure of contact VSR. However, as long as the register error exceeds the preset limit, tension on the web is at its maximum (or minimum) value and the motor 48 and compensator 40 cannot operate. However, as the repeat length error changes in magnitude and comes back within the preset limits, the fact that a circuit is completed across the terminals T3 and T73 of register control 47 (which has the same effect as if the reset switch 78 were manually closed), the motor 48 and compensator 40 come back into operation within the preset limits but at such new level as to maintain the new tension level on the web.

Referring to FIG. 6*a*, there is depicted a condition wherein infeed tension (in PLI) gradually increases from 10 lbs. to 18 lbs. as a period of time elapses necessary to unwind three-quarters of the roll and then gradually declines. Thus, the web condition requires an infeed tension which would range from 10–18 PLI. However, if the PLI tension limit is set at 16 PLI, it will be observed that there is a period of time during which more than 16 PLI is required but only 16 PLI is available.

Referring now to FIG. 6*b* there is depicted the register error readout without the availability of the reset function provided by the circuit shown in FIG. 5. In this situation, the register error readout is approximately 00 until the 16 PLI limit is reached whereupon register error readout increases since the control is not active beyond the limit set at 16 PLI, for example. When web conditions require 16 PLI or less, the control is active and returns the repeat length to the initial established length.

FIG. 6*c* depicts the situation regarding register error readout with reset. In this situation, register error readout remains at approximately 00 until the 16 PLI limit is exceeded whereupon register error readout begins to increase to a readout of between 25 and 50 and then sharply drops to near zero; this increase and sharp drop-off occurring repeatedly until the tension level of 16 PLI is established. Note that in this case the controller 47 has repeatedly been reset (a new repeat length established with a new control point). The advantage here is that as soon as the web conditions are such to require 16 PLI or less of tension, the controller is immediately able to control eliminating the time TI shown in FIG. 6*b*.

The graph in FIG. 6*d* depicts a situation which would occur in a system in not using a key color control system in accordance with the invention and wherein constant tension is applied to the web.

FIG. 6*e* depicts a situation wherein a key color control system in accordance with the invention but without the reset function is employed. In this circumstance, register error readout remains at approximately 00 until the 16 PLI tension limit is exceeded, whereupon register error readout increases until it reaches the 18 PLI limit and then recedes until the tension level required is 16 PLI or less. However, in FIG. 6*e*, it will be noted that there is a short period of time after which a register error occurs even though there has been a return to the 16 PLI limit. It is desirable that this period of time be eliminated and as comparison of FIGS. 6*c* and 6*f* shows, the reset circuit shown in FIGS. 2 and 5 enables the register controller to be immediately operative as soon as the 16 PLI limit is returned to.

SUMMARY OF OPERATION

As is apparent from the foregoing, changes in web conditions effect changes in print, namely, changes in repeat length of the key color. This, in turn, results usually in excessive compensator activity, press instability relative to the web W, and unstable registration. It is desirable, therefore, to improve registration at the key color deck A to reduce web spoilage. The key color register or repeat length control system in accordance with the invention compensates for web condition changes before the web enters the press, rather than letting the primary register control compensate for web changes, which causes register disturbances throughout the press 10. The repeat length control system varies infeed web tension so that key color nip feed characteristics change to maintain constant repeat length. The repeat length of the key color is measured and when a change is detected, the closed loop system varies the infeed dancer pressure to maintain constant key color repeat length. The repeat length control system presupposes that infeed is stable, and that web tension limits are not exceeded.

The repeat length control system employs a scanner 45 located downstream of a key color deck, such as deck A, to measure repeat length on web W and to provide an error signal. The scanner 45 is portable and can be used at any one of the decks A, B, C, D selected as the key color deck. The register control 47, which is located at the main operator station, receives the error signal and computes changes in repeat length and provides a control signal to operate the electric motor 48 for the air regulator valve 49 on the air regulator control panel 47*a*, which is located at the press infeed. The valve 49 on the air regulator control panel 47*a* varies air pressure to the cylinder 43 for the infeed dancer 40 to provide proportional air loading. The PLI limit control panel 50, which is located at the main operator station, embodies the dial-in web width control means 54 and the anticipatory PLI limit visual warning means 55 as well as the PLI maximum limit alarm means 56 and its visual and audible warning devices 58 and 62, respectively. The PLI limit control panel 50 also contains an automatic register control reset circuit Z, shown in FIGS. 2 and 5, and the continuous infeed tension meters 63 giving a reading in PLI.

For start-up, the operator dials in the web width by means of a thumb wheel in web width selector switch 54. The operator then sets the max-min PLI limits and anticipate limits by adjusting relays 56 and 55. The operator then selects the web mark for scanner 45 and sets register control 47 to automatic. During a press run, the key color control is operational above the go-down speed. The operator may reset the infeed tension limits at 56 while the press is running, if desired. In automatic operation, the control system controls infeed tension to maintain constant key color repeat length within the limits set at start-up. These limits may be reset or a new repeat length may be selected during running if desired.

We claim:

1. A register control system for controlling printing repeat length in a printing press comprising:

a printing deck for imprinting repeats and corresponding register marks on a web;

first means to establish a desired repeat length, to detect and measure the magnitude and direction of a repeat length error and for providing an error signal related thereto, said first means comprising a scanner located downstream of said printing deck for sensing said register mark and a register control connected to said scanner, said register control comprising a counter;

second means connected to said first means to receive said error signal and to correct for said repeat length error by adjusting the tension level on said web ahead of said printing deck, said second means comprising a dancer and a motor for controlling operation of said dancer, said motor having a motor control for receiving error signals from said register control;

third means connected to said first means to establish limits within which repeat length errors are likely to occur and for which correction in tension level is to be made so as to reduce said repeat length error, said third means comprising a high limit relay and a low limit relay, said relays being connected to said register control to prevent operation of said motor when said limits are exceeded, said relays being responsive to an electric signal from a potentiometer responsive to the position of said motor;

and fourth means connected to said second means for determining and indicating that repeat length errors are trending to depart from said limits, said fourth means comprising a warning signal device responsive to said electric signal from said potentiometer.

2. A register control system according to claim 1 wherein said register control includes means whereby it can be adjusted to establish a new desired repeat length and including reset means connected to said first means and operable after said register control is adjusted to establish said new desired repeat length to enable said second means to establish said new repeat length within said established limits when said repeat length errors return within said established limits, said reset means comprising a circuit for sensing the count being made by said counter in said register control and for effecting operation of said motor when a predetermined count has been reached within said established limits.

* * * * *